US005078105A

United States Patent [19]

Ito et al.

[11] Patent Number: 5,078,105

[45] Date of Patent: Jan. 7, 1992

[54] ENGINE FOR VEHICLE

[75] Inventors: Mitsuo Ito; Yorio Futakuchi; Mamoru Atsuumi, all of Iwata, Japan

[73] Assignee: Yamaha Hatsudoki Kabushiki Kaisha, Japan

[21] Appl. No.: 424,985

[22] Filed: Oct. 23, 1989

[30] Foreign Application Priority Data

Oct. 21, 1988 [JP] Japan ..... 63-266939
Oct. 21, 1988 [JP] Japan ..... 63-266941

[51] Int. Cl.[5] ..... F07F 7/00

[52] U.S. Cl. ..... 123/195 R; 123/195 AC; 123/197.5; 74/603; 74/606 R; 180/24

[58] Field of Search ..... 123/195 AC, 197 C, 90.27, 123/195 R, 192 B; 74/603, 573 R, 606 R; 180/218, 241, 297, 312

[56] References Cited

U.S. PATENT DOCUMENTS 4,550,698 11/1985 Könneker ..... 123/195 AC
4,572,025 2/1986 Mitchell ..... 123/192 B
4,606,310 8/1986 Makino ..... 123/192 B
4,633,826 1/1987 Tominaga et al. ..... 123/90.27
4,798,254 1/1989 Lings ..... 123/195 AC

FOREIGN PATENT DOCUMENTS 2913076 10/1979 Fed. Rep. of Germany ... 123/195 R
2155404 10/1982 Fed. Rep. of Germany ... 123/192 B
0048707 4/1977 Japan ..... 74/603
0072630 5/1980 Japan ..... 123/195 R
0039863 3/1983 Japan ..... 74/603
0065643 4/1984 Japan ..... 74/603

*Primary Examiner*—Willis R. Wolfe
*Assistant Examiner*—Tom Moulis
*Attorney, Agent, or Firm*—Laff, Whitesel, Conte & Saret

[57] ABSTRACT

An engine having a crank case splitted into upper and lower crank cases, and including a crank shaft and a transmission drive shaft disposed on the split plane between the upper crank case and the lower crank case and a transmission main shaft carried by either one of the upper or lower crank case. The length and the size of the engine can be reduced by the arrangement according to the invention, and a starter motor, a transmission drum and balancers can be arranged efficiently to save space required for mounting the engine.

10 Claims, 5 Drawing Sheets

ENGINE FOR VEHICLE

BACKGROUND OF THE INVENTION

1. Field of the Invention

The present invention relates to an engine adapted to be mounted on a motor bicycle, and particlularly to such an engine which is reduced in size by decreasing the length of the crank case to make it possible to decrease the wheel base (i.e. the distance from the front wheel to the rear wheel of the motor bicycle). More particularly, it relates to an engine in which the crank shaft, the transmission main shaft and the transmission drive shaft are arranged in a unique fashion.

2. Prior Art Statement

In the engine for a motor bicylce, it is a common practice to arrange a crank shaft and a transmission having a main shaft and a drive shaft within a crank case. In order to improve the production efficiency in assembling the parts, it has been proposed to split the crank case into an upper and lower crank cases so that the crank shaft, the transmission main shaft and the transmission drive shaft are disposed on the split plane between the upper and lower crank cases, as disclosed, for example, by Japanese Patent Laid-Open Publication No. 79020/1984.

However, when the crank shaft and the main and drive shafts of the transmission are disposed in-between the split plane between the upper and lower crank cases, the length of the crank case is increased to pose a problem that the size of the engine 15 increased. The rear arms for carrying the rear wheel is pivoted near the point of the frame of the vehicle body at which the engine is suspended. As the length of the engine is increased, the length of the wheel base is also increased correspondingly.

OBJECT AND SUMMARY OF THE INVENTION

The principal object of this invention is to provide an engine having its length decreased to be reduced in size so that the wheel base of the vehicle can be decreased.

The object of this invention is achieved by the provision of an engine for a vehicle mounted at a position in front of a rear arm which is swingable in the vertical direction and has a rear end carrying at least one rear wheel, comprising:

a crank case including an upper crank case and a lower crank case splitted from each other by a split plane, a crank shaft and a transmission drive shaft disposed on the split plane between the upper crank case and the lower crank case and extending in the width direction of the frame of the vehicle, and a transmission main shaft carried by either one of the upper or lower crank case.

In the engine according to this invention, since the transmission main shaft is disposed in the upper or lower crank case so as to arrange the transmission drive shaft at a position closer to the crank shaft, the length of the crank case and as thus the length of the engine can be decreased. The size of the engine is reduced correspondingly to ensure decrease in length of the wheel base of the vehicle. Moreover, the pivot support for the rear arm is formed on the crank case so that the rear arm is carried by the pivot support and the engine is also suspended by the same pivot support. Thus, the pivot support for the rear arm is coincident with the point at which the engine is carried by the frame of the vehicle body to contribute decrease in length of the wheel base.

According to a further aspect of this invention, a starter motor, a transmission drum and balancers may be arranged efficiently to further decrease the length of the engine.

The object of this invention may also be achieved by the provision of an engine for a vehicle adapted to be carried in the vicinity of the center of the frame of said vehicle, said engine including a crank case carrying a crank shaft and a transmission main shaft and a transmission drive shaft disposed behind said crank shaft, said crank shaft, transmission main shaft and transmission drive shaft extending in the width direction of said frame, wherein the line extending along the center axis of the cylinder of said engine and the line connecting the center axis of said transmission main shaft with the center axis of said crank shaft are inclined upwards so that these lines form a first letter V having its opening at the upside, wherein the line connecting the center axis of said crank shaft with the center axis of said transmission main shaft and the line connecting the center axis of said transmission main shaft with the center axis of said transmission drive shaft are inclined downwards so that these lines form a second letter V having its opening at the downside, and wherein an intake passage is rising upwards from a plane opposing to said opening of said first letter V.

The lines connecting the crank shaft, the transmission main shaft and the transmission drive shaft form a crank-shape relative to the cylinder of the engine so that a down-draft type carbreter may be disposed in the space having the section of letter V which has its opening at the upside.

DETAILED DESCRIPTION OF PREFERRED EMBODIMENT

The present invention will be described in detail with reference to a preferred embodiment shown in FIGS. 1 to 5.

Figure 5:
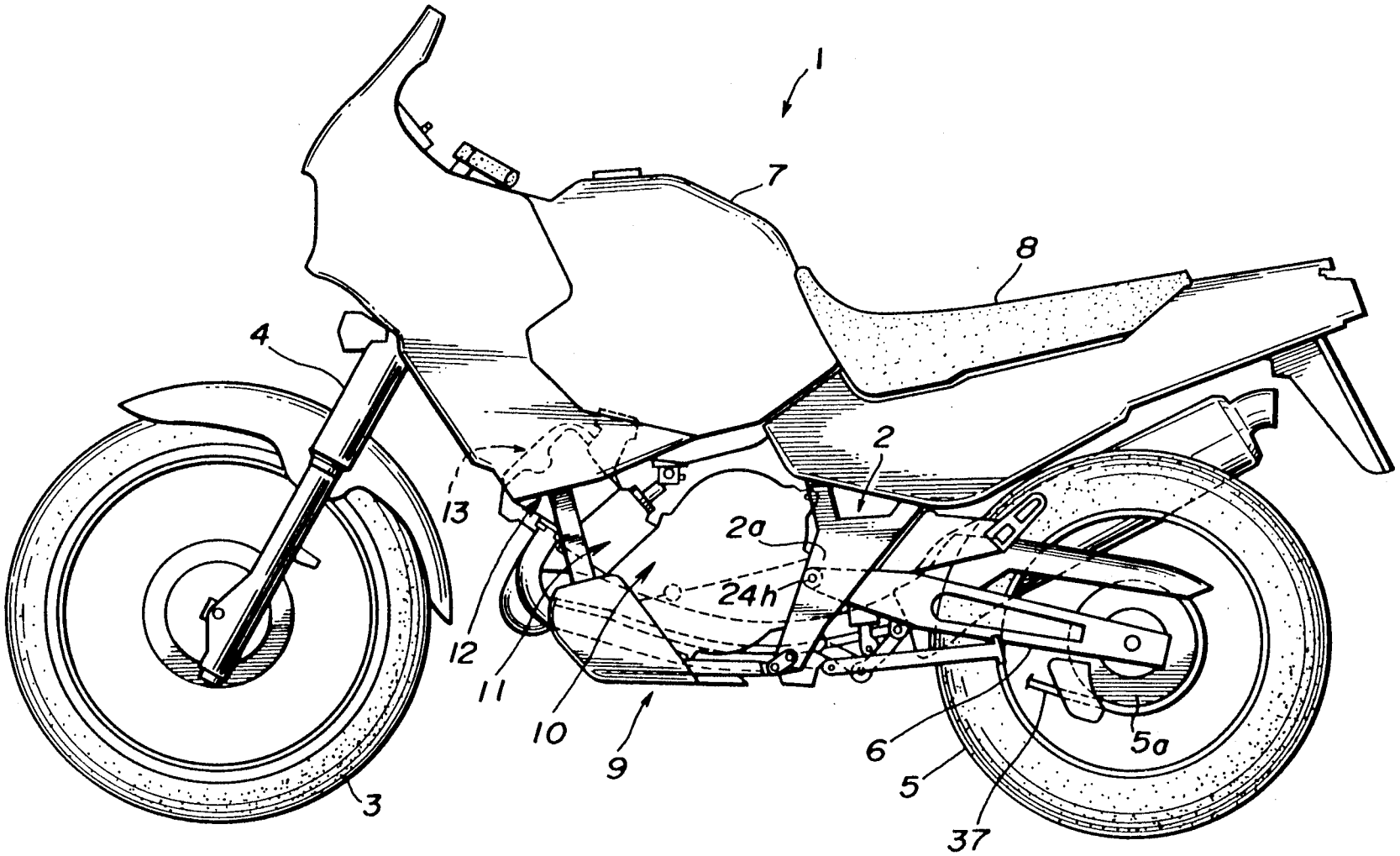
FIG. 5 is a side elevation of a motor bicycle in which the engine shown in FIG. 1 is mounted.

Initially referring to FIG. 5, an engine embodying the present invention is mounted in a motor bicycle 1 which comprises a frame 2 having a front end for swingably carrying a front fork 4 which in turn carries a front wheel 3 at the lower end thereof. A rear arm 6 is carried at the middle portion of the frame 2 and has a rear end carrying a rear wheel 5, the rear arm 6 being pivoted swingably in the vertical direction. A large-size fuel tank 7 and a seat 8 are mounted on the upper side of the frame 2. An engine unit 8 is suspended from the frame 2 to be disposed below the fuel tank 7.

In the illustrated embodiment, the engine unit 9 is a water-cooled 4-cycle parallel 2-cylinder type engine having a cylinder block 11, cylinder heads 12 and a head cover 13 each inclined relative to the horizontal plane by an angle of about 45 degrees to extend in the forward direction.

In the left and right cylinders 11*a*, 11*b* of the cylinder block 11, combustion chambers 14 are formed by pistons 14*a*, 14*b* and recesses 12*a*, 12*b* of the cylinder heads 12. Each combustion chamber 14 is communicated with an intake port through three intake valves 15*a* and communicated with an exhaust port through two exhaust valves 15*b*. Each intake valve 15*a* engages with an intake cam shaft 16*a* and each exhaust valve 15*b* engages with an exhaust cam shaft 16*b*, and each of the intake cam shaft 16*a* and the exhaust cam shaft 16*b* has the right end (when viewed from the rear side of the vehicle) secured to a cam follower sprocket 16*c*.

The pistons 14*a*, 14*b* are connected through connecting rods 17*a*, 17*b* to crank arms 18*a*, 18*b* composed of paired webs of a crank shaft 18 connected by crank pins. A drive sprocket 18*c* is formed integrally with the crank shaft 18 and protrudes beyond the right end (as viewed in FIG. 3) of the crank shaft 18. A cam chain 20 runs over the sprocket 18*c* and the cam follower sprocket 16*c* of the cam shafts 16*a*, 16*b*. The cam chain 20 is housed in a chain case sections 11*c*, 12*c* and 23*a* protruding, respectively, from the cylinder block 11, the cylinder heads 12 and an upper crank case 23. A tensioner 60 is disposed behind the cam chain 20 and has a chain pressing member 60*a* having its lower end pivotally carried by a pin 61*a* (as viewed in FIG. 2). A bolt 10*a* is positioned outside of the pin 61*a* to extend in the direction substantially perpendicular to the axis of the pin 61*a* so as to prevent the pin 61*a* from slipping out of the position. As will be described hereinafter, the upper and lower crank cases are connected by the bolt 10*a* to form a united crank case 10.

Figure 1:
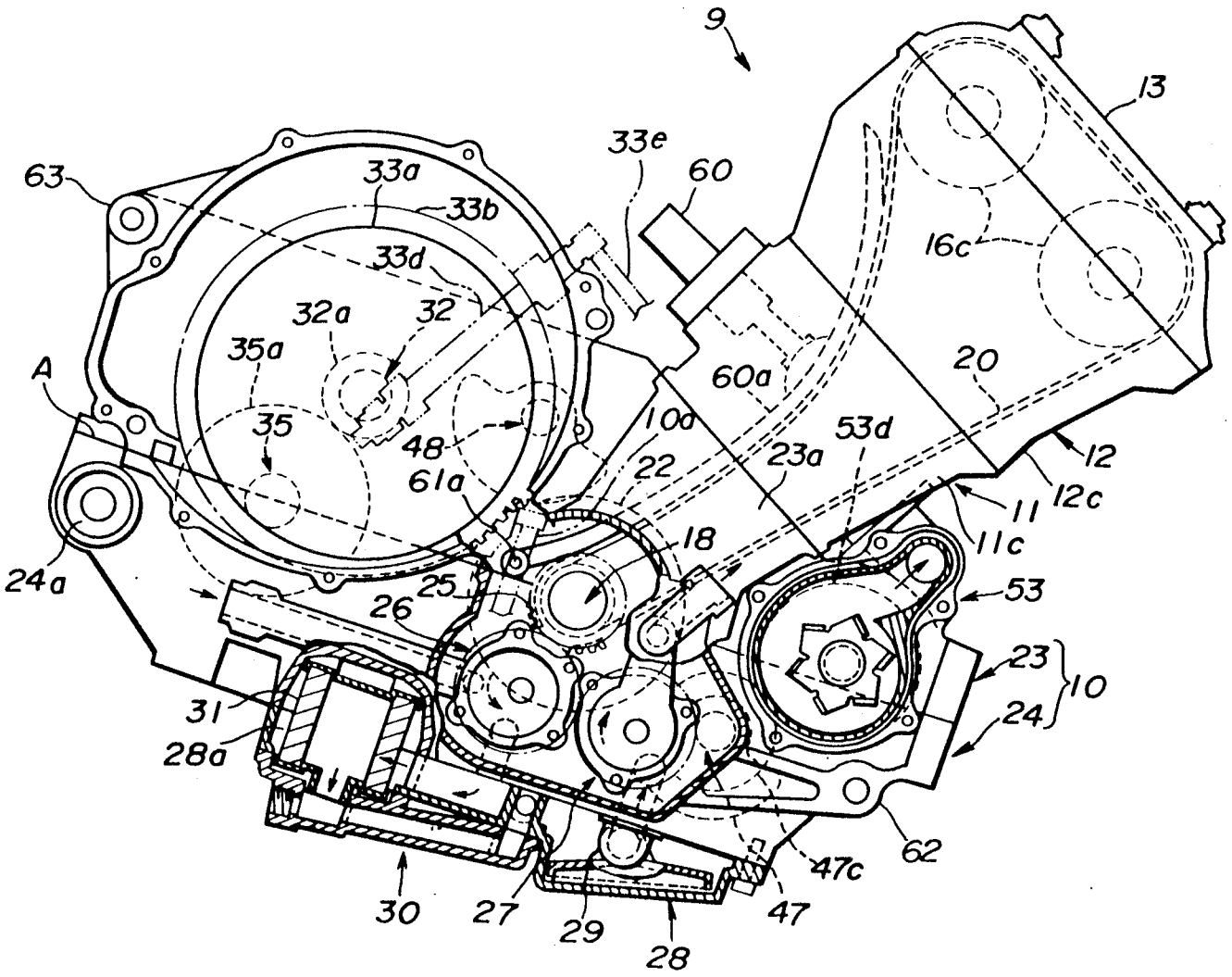
FIG. 1 is a sectional view of an engine embodying the invention when taken along a lengthwise direction and viewed from the right side of the section.

A pump drive gear 25 is mounted at the right end (as viewed in FIG. 3) of the crank shaft 18, and an oil feed pump 26 is disposed below the pump drive gear 25, the oil feed pump feeding the lubricating oil from an oil tank (not shown) serving as an oil cooler to the portions, such as bearings 19*a* to 19*c*, to which lubricating oil should be fed. A scavenge oil pump 27 for feeding the lubricating oil into the oil tank is also disposed below the pump drive gear 25 at a position in front of the oil feed pump 26. As shown in FIG. 1, a water pump 53 for recirculating cooling water is disposed in a recessed segment at the right end portion of the crank case 10 (as viewed in FIG. 1), the water pump 53 being positioned in front of the chain case 23*a*. In FIG. 1, reference numeral 29 designates an oil strainer, reference numeral 31 designates an oil cleaner and reference numeral 30 designates a cap. A cleaner chamber 28*a* is thus defined by the lower crank case 24, an oil pan 28 and the cap 30.

The crank case 10 is splitted into two sections, i.e. the upper crank case 23 and the lower crank case 24, and the split plane A between the upper and lower crank cases 23 and 24 is inclined so that the front portion is lowered when the engine is mounted on the bicycle. The crank shaft 18 is disposed on the split plane A at a position frontal relative to a main shaft 32 and a drive shaft 35 of a transmission. The portion of the crank shaft 18 between the crank arms 18*a* and 18*b* is supported by a central bearing 19*c*, and the left and right end portions of the crank shaft 18 are supported by left and right bearings 19*a* and 19*b*. A front balancer shaft 47 extends parallel to the crank shaft 18 and is disposed in the lower crank case 24 at a position in front of the crank shaft 18, whereas a rear balancer shaft 48 extends parallel to the crank shaft 18 and is disposed in the upper crank case 23 at a position behind the crank shaft 18. The front balancer shaft 47 is thus positioned below the split plane A and the rear balancer shaft is positioned above the split plane A, and the line L connecting the center axis of the front-lower balancer shaft 47 and the center axis of the rear-upper balancer shaft 48 crosses the split plane A at a position in front of the center axis of the crank shaft 18, as best seen from FIG. 2.

Figure 3:
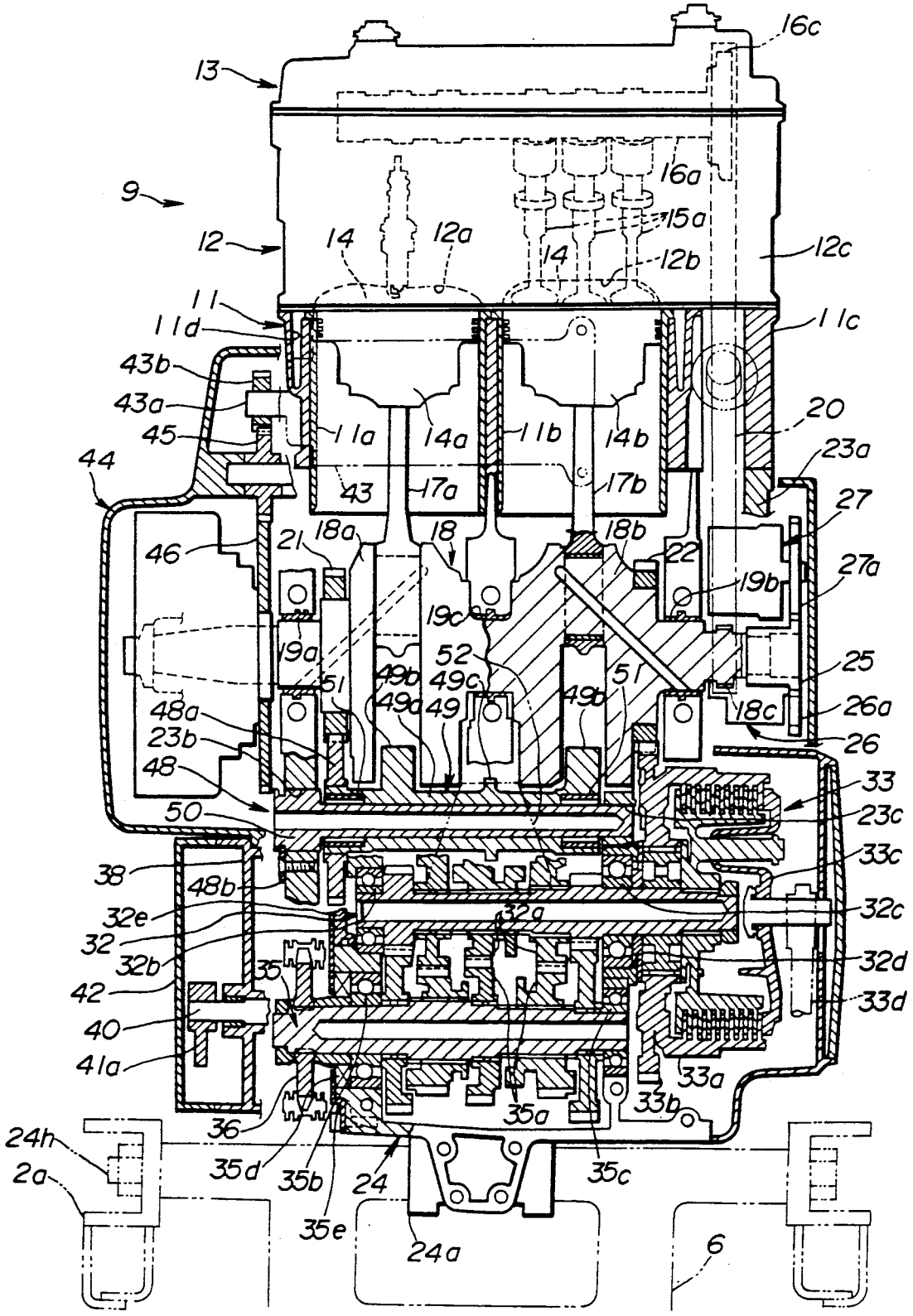
FIG. 3 is a sectional view of the engine embodying the invention and shown in FIG. 1 when taken along a vertical plane.
Figure 4:
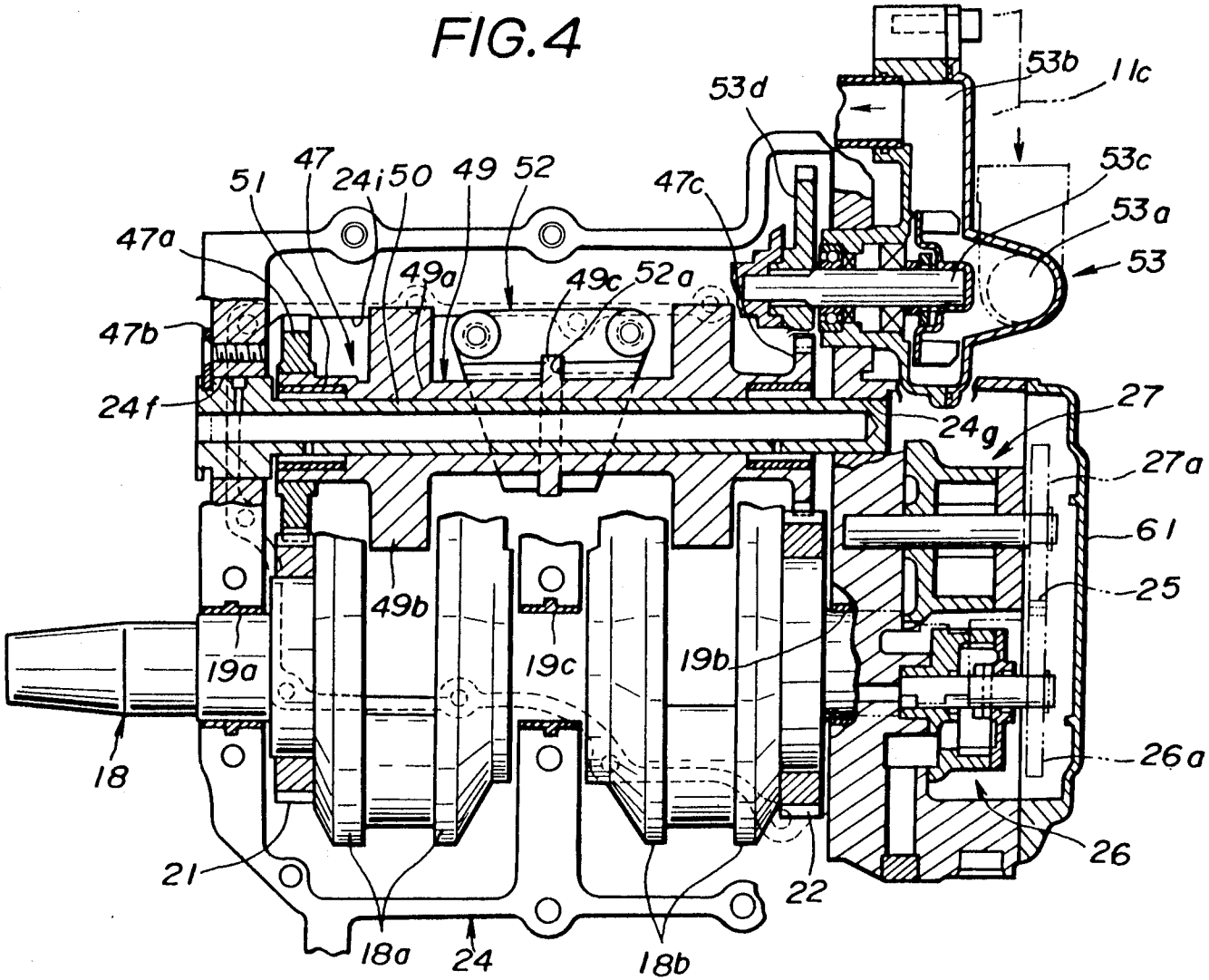
FIG. 4 is a sectional view of the engine embodying the invention and shown in FIG. 1 when taken along a plane containing the center axis of the front balancer shaft.

As shown in FIGS. 3 and 4, each of the front and rear balancer shafts 47, 48 comprises a balancer body 49, a support shaft 50 inserted through the balancer body 49 and needle bearings 51 disposed between the balancer body 49 and the support shaft 50. The support shaft 50 of the rear balancer shaft 48 is inserted through an opening 23*b* formed through the left side wall (as viewed in FIG. 3) of the upper crank case 23, and one end thereof is carried by a support opening 23*c* formed through the right side wall (as viewed in FIG. 3) of the upper crank case 23 and the other end thereof is secured to the left side wall of the upper crank case 23 by a keep plate 48*b*. The support shaft 50 of the front balancer shaft 47 is inserted through an opening 24*f* formed through the left side wall (as viewed in FIG. 4) of the lower crank case 24, and one end thereof is carried by a support opening 24*g* formed through the right side wall (as viewed in FIG. 4) of the lower crank case 24 and the other end thereof is secured to the left side wall of the lower crank case 24 by a keep plate 47*b*.

Figure 2:
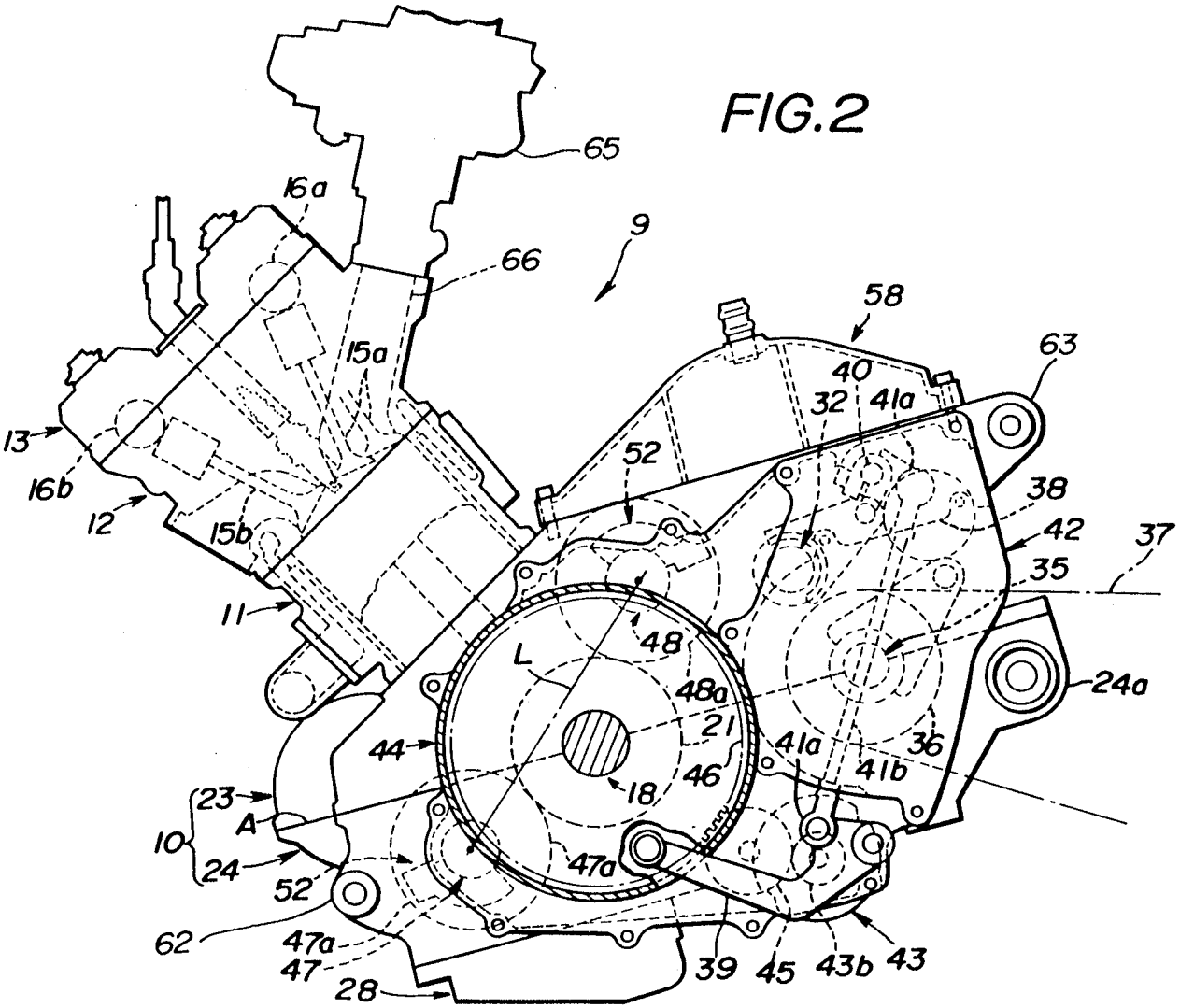
FIG. 2 is a sectional view of the engine embodying the invention and shown in FIG. 1 when taken along a lengthwise direction and viewed from the left side of the section.

The balancer body 49 comprises an integral cylinder 49*a* having weight segments 49*b* at the ends thereof and a positioner segment 49*c* at the substantial center thereof. The weight segments 49*b* are positioned in the spaces between the webs of the crank arms 18*a*, 18*b* of the crank shaft 18. The center positioner segment 49*c* extends above and below each of the balancer shafts 47, 48 to be received by guide ditches 52*a* of a positioner plate 52 which is fixed to the crank case 10, so that each of the balancer shafts 47, 48 is set in position along the axial direction. The driven gears 47*a*, 48*a* which are fixedly secured to the left ends of the balancer bodies 49, 49 mesh with a balancer gear 21 so that the balancer shafts 47, 48 are rotated in the direction reverse to the rotating direction of the crank shaft 18. Referring to FIG. 2, reference numeral 58 designates a bleezer cover defining a bleezer chamber, and the bleezer cover 58 may be removed to allow access into the upper crank case 23, for example, when the rear balancer shaft 48 is assembled.

A transmission main shaft 32 (hereinafter referred to simply as "main shaft") extends through the upper crank case 23 at a position behind the crank shaft 18 and above the split plane A, and a transmission drive shaft 35 (hereinafter referred to simply as "drive shaft") is positioned on the split plane A and behind the main shaft 32. The line extending along the center axis of the cylinder and the line connecting the center axis of the crank shaft 18 with the center axis of the main shaft 32 form a first letter V having its opening at the upside, and the line connecting the center axis of the crank shaft 18 with the center axis of the main shaft 32 and the line connecting the center axis of the main shaft 32 with the center axis of the drive shaft 35 form a second letter V having its opening at the downside. A down draft type carburetor 65 is disposed above the space of the first letter V formed by the line extending along the center axis of the cylinder and the line connecting the center axis of the crank shaft 18 with the center axis of the main shaft 32, and an intake passage 66 is rising towards the carburetor 65 (see FIG. 2).

The left and right ends of the main shaft 32 are carried by bearings 32*b* and 32*c*, and the ends of the drive shaft 35 are carried by bearings 35*b* and 35*c*. The right bearing 32*c* for the main shaft 32 is mounted through a housing 32*d* having a diameter larger than the diameter of a final drive gear 32*a* mounted on the main shaft 32 to the right side wall of the upper crank case 23. An opening is formed at the portion at which the left bearing 32*b* is arranged so that the main shaft 32 may be removed through the opening as desired, and this opening is closed by securing a cap 32*e*. The cap 32*e* and an oil seal 35*d* disposed on the outside face of the left bearing 35*b* of the drive shaft 35 are pressed by a metal pressing plate 35*e* which is fixedly secured to the left side wall of the crank case 10.

A wet multi-plate clutch 33 is mounted on the right end (as viewed in FIG. 3) of the main shaft 32, and a spur gear 33*b* fixed to the clutch outer 33*a* of the clutch 33 meshes with a small spur gear 22 fixed to the crank shaft 18. The clutch 33 further comprises a pressing member 33*c* which is moved by a control shaft 33*d*. The control shaft 33*d* is inclined forwards from the vertical direction when viewed from the right side of the vehicle, and a clutch cable 33*e* extends behind the cylinder block 11 along the left side of the vehicle body in a manner so that it is not concaved towards the downside, the clutch cable 33*e* being connected to a left grip of the control handle (see FIG. 1). One of the transmission gears 32*a* mounted on the main shaft 32 meshes with one of the transmission gears 35*a* mounted on the drive shaft 35*a* to form a constant-mesh type transmission.

The left end of the drive shaft 35 protrudes beyond the left side wall of the crank case 10, and a sprocket 36 for driving the rear wheel is mounted on the protruding end. A power transmission chain 37 runs around the sprocket 36 and a driven sprocket 5*a* of the rear wheel 5 (see FIGS. 2 and 5). The outside of the sprocket 36 is covered by a chain cover 38 which serves to shield the chain 37 and the sprocket 36 to prevent sticking of splashes of mud (see FIG. 3). A shift pedal 39 is disposed below the drive sprocket 36 and connected through a link rod 41*b*, which has universal joints 41*a* at the ends thereof and extending vertically at the outside of the drive sprocket 36, to a shift shaft 40 disposed above the drive sprocket 36. The link rod 41*b* is covered by a case cover 42 (see FIG. 2).

Pivot supports 24*a* are integrally formed at the rear end portions of the lower crank case 24 of the crank case 10. The front ends of the rear arms 6 are positioned outside of the pivot supports 24*a* and support brackets 2*a* of the frame 2 are positioned outside of the rear arms 6, a pivot shaft 24*h* being inserted through these members. The engine unit 9 is suspended and the rear arms 6 are pivoted by the pivot shaft 24*h* and the pivot supports 24*a*. Mounting means for mounting the engine 9 to the frame 2 are denoted by 62 and 63 in FIGS. 2 and 3.

In FIGS. 2 and 3, reference numeral 43 designates a starter motor which is disposed in the lower crank case 24. The starter motor 43 has an output shaft 43*a* on which a drive gear 43*b* is mounted. The drive gear 43*b* meshes through an idle gear 45 with a starter gear 46 mounted on the crank shaft 18 through a one-way clutch. According to the illustrated embodiment of the invention, the main shaft 32 is disposed in the upper crank case 23 and the starter motor 43 is disposed in the space left vacant in the lower crank case, whereby the size of the engine is significantly reduced.

According to the illustrated embodiment of the invention, the crank case 10 is splitted into the upper and lower crank cases 23, 24, the crank shaft 18 and the drive shaft 35 being disposed on the split plane and the main shaft 32 being disposed in the upper crank case 23 at a position between the crank shaft 18 and the drive shaft 35 and above the split plane A. As a result, the drive shaft 35 is positioned closer to the crank shaft 18 to decrease the length of the crank case correspondingly, whereby the size of the engine is reduced and the wheel base of the vehicle is also decreased.

Furthermore, the pivot supports 24*a* for pivotally carrying the rear arms 6 are formed integrally with the lower crank case 24 and the pivot supports 24*a* are carried by the support brackets 2*a* of the frame 2 together with the front ends of the rear arms 6, whereby the engine suspending point and the rear arm pivoting point are coincident with each other to contribute decrease in length of the wheel base.

Although the present invention has been described with reference to a preferred embodiment thereof, many modifications and alternations may be made by a person having ordinary skill in the art without departing from the scope of the invention which is defined by the appended claims. For example, although the main shaft 32 is disposed in the upper crank case 23 in the illustrated embodiment, the main shaft 32 may be disposed in the lower crank case. Although the pivot supports 24*a* are formed integrally with the lower crank case 24 in the illustrated embodiment, they may be formed integrally with the upper crank case 23 or may be formed such that the center axes thereof extend along the split plane A. Substantially equivalent effects as obtained by the illustrated embodiment can be obtained by arranging the main shaft 32 in the lower crank case 24 or by arranging the pivot supports 24*a* in the modified manner as described above.

What is claimed is:

1. An engine for a vehicle mounted at a position in front of a rear arm which is swingable in a vertical direction and has a rear end carrying at least one rear wheel, said engine comprising:

a crank case including an upper crank case and a lower crank case split from each other along a split plane, a crank shaft and a transmission drive shaft disposed on the split plane between the upper crank case and the lower crank case and extending in the width direction of the frame of the vehicle, and a transmission main shaft carried by either one of the upper or lower crank cases, said transmission main shaft being disposed behind said crank shaft and said transmission drive shaft being disposed behind said transmission main shaft, and said rear arm having a pivot axis carried by a pivot axis support disposed in the rear portion of said crank case, said transmission main shaft being disposed at one side of the split plane between said upper and lower crank cases, and said pivot axis support being disposed at the other side opposing said one side beyond said split plane.

2. An engine for a vehicle mounted at a position in front of a rear arm which is swingable in a vertical direction and has a rear end carrying at least one rear wheel, said engine comprising:

a crank case including an upper crank case and a lower crank case split from each other by a split plane, a crank shaft and a transmission drive shaft disposed on the split plane between the upper crank case and the lower crank case and extending in the width direction of the frame of the vehicle, and a transmission main shaft carried by either one of the upper or lower crank case, said transmission main shaft being disposed at one side of the split plane between said upper and lower crank cases, and further comprising a starter motor disposed between said crank shaft and said transmission drive shaft and at the other side opposing said one side beyond said split plane.

3. An engine for a vehicle mounted at a position in front of a rear arm which is swingable in a vertical direction and has a rear end carrying at least one rear wheel, said engine comprising:

a crank case including an upper crank case and a lower crank case split from each other by a split plane, a crank shaft and transmission drive shaft disposed on the split plane between the upper crank case and the lower crank case and extending in the width direction of the frame of the vehicle, a transmission main shaft carried by either one of the upper or lower crank case, and a shift shaft disposed at either one of the upper or lower crank case by which said transmission main shaft is carried, wherein said transmission main shaft is disposed behind said crank shaft, and wherein said transmission drive shaft and said shift shaft are disposed behind said transmission main shaft.

4. An engine for a motor bicycle having a steerable front wheel and a driven rear wheel, said engine being mounted at a position in front of a rear arm which is swingable in a vertical direction and has a rear end carrying at least one driven rear wheel, said engine comprising:

a crank case including an upper crank case and a lower crank case split from each other by a split plane, a crank shaft and a transmission drive shaft disposed on the split plane between the upper crank case and the lower crank case and extending in the width direction of the frame of the vehicle, and a transmission main shaft carried by either one of the upper or lower crank case, said split plane between said upper and lower crank cases being declined so that the front part of said crank case nearest said steerable wheel is lower than the rear part of said crank case which is nearest said driven wheel, the center axis of said steerable front wheel being positioned above a plane extended along and containing said split plane when the engine is mounted on the motor bicycle.

5. The engine for a vehicle according to claim 4, wherein said transmission main shaft is disposed in said upper crank case and said pivot axis support is disposed in said lower crank case.

6. An engine for a vehicle mounted at a position in front of a rear arm which is swingable in a vertical direction and has a rear end carrying at least one rear wheel, said engine comprising:

a crank case including an upper crank case and a lower crank case split from each other by a split plane, a crank shaft and a transmission drive shaft disposed on the split plane between the upper crank case and the lower crank case and extending in the width direction of the frame of the vehicle, and a transmission main shaft carried by either one of the upper or lower crank case, a line extending along a center axis of the cylinder of said engine and a line connecting the center axis of said transmission main shaft with a center axis of said crank shaft being inclined upwards so that these lines form a somewhat V-shape having its opening at the upside, and the line connecting the center axis of said crank shaft with the center axis of said transmission main shaft and the line connecting the center axis of said transmission main shaft with the center axis of said transmission drive shaft being inclined downwards so that these lines form another somewhat V-shape having its opening at the downside.

7. An engine for a vehicle adapted to be carried in the vicinity of the center of the frame of said vehicle, said engine including a crank case carrying a crank shaft and a transmission main shaft and a transmission drive shaft disposed behind said crank shaft, said crank shaft, transmission main shaft and transmission drive shaft extending in the width direction of said frame, wherein the line extending along the center axis of the cylinder of said engine and the line connecting the center axis of said transmission main shaft with the center axis of said crank shaft are inclined upwards so that these lines form a first letter V having its opening at the upside, wherein the line connecting the center axis said crank shaft with the center axis of said transmission main shaft and the line connecting the center axis of said transmission main shaft with the center axis of said transmission drive shaft are inclined downwards so that these lines form a second letter V having its opening at the downside, and wherein an intake passage is rising upwards from a plane opposing to said opening of said first letter V.

8. An engine for a vehicle adapted to be carried in the vicinity of the center of the frame of said vehicle, said engine including a crank case carrying a crank shaft and a transmission main shaft and a transmission drive shaft disposed behind said crank shaft, said crank shaft, transmission main shaft and transmission drive shaft extending in the width direction of said frame, wherein the line extending along the center axis of the cylinder of said engine and the line connecting the center axis of said transmission main shaft with the center axis of said crank shaft are inclined upwards so that these lines form a first letter V having its opening at the upside, wherein the line connecting the center axis of said crank shaft with the center axis of said transmission main shaft and the line connecting the center axis of said transmission main shaft with the center axis of said transmission drive shaft are inclined downwards so that these lines form a second letter V having its opening at the downside, and wherein a balancer shaft is disposed in the opening of said first letter V and another balancer shaft is disposed below said cylinder.

9. An engine for a vehicle according to claim 8, wherein said crank case is splitted into an upper crank case and a lower crank case, and wherein one of the balancer shafts is disposed in said upper crank case and the other of said balancer shaft is disposed in said lower crank case.

10. The engine for a vehicle according to claim 3, wherein said transmission shaft and said shift shaft are disposed in said upper crank case, and further comprising a shift pedal disposed outside said lower crank case.

* * * * *